US007938398B2

(12) United States Patent
Yamauchi et al.

(10) Patent No.: US 7,938,398 B2
(45) Date of Patent: May 10, 2011

(54) PAPER FEEDING APPARATUS

(75) Inventors: Kohichi Yamauchi, Yamato-Koriyama (JP); Nobuo Manabe, Yamato-Koriyama (JP); Kohichi Nakamura, Kizugawa (JP); Shinichi Takeda, Ikoma (JP); Ayumu Oda, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 454 days.

(21) Appl. No.: 12/107,297

(22) Filed: Apr. 22, 2008

(65) Prior Publication Data

US 2008/0265491 A1 Oct. 30, 2008

(30) Foreign Application Priority Data

Apr. 26, 2007 (JP) ..... 2007-117098

(51) Int. Cl.
*B65H 1/22* (2006.01)

(52) U.S. Cl. ..... 271/164; 399/393

(58) Field of Classification Search ..... 271/162–164; 399/393

See application file for complete search history.

(56) References Cited

U.S. PATENT DOCUMENTS 4,530,547 A * 7/1985 Rock et al. ..... 384/19
5,624,108 A * 4/1997 Kubo ..... 271/9.12
2004/0131384 A1 7/2004 Miyaji et al.

FOREIGN PATENT DOCUMENTS

| | | |
|---|---|---|
| JP | 61-060534 | 3/1986 |
| JP | 04-272035 | 9/1992 |
| JP | 06-247569 | 9/1994 |
| JP | 07-117868 | 5/1995 |
| JP | 2849433 | 11/1999 |
| JP | 2000-072260 | 3/2000 |

* cited by examiner

*Primary Examiner* — Michael C McCullough
(74) *Attorney, Agent, or Firm* — Renner, Otto, Boisselle & Sklar, LLP

(57) ABSTRACT

A paper feeding apparatus used in a state where the apparatus accumulates paper sheets for an image forming apparatus to form images thereon and the paper feeding apparatus is attached to a main body of the image forming apparatus, wherein an engaging-holding member is provided for an exterior wall face of the paper feeding apparatus, and the engaging-holding member engages and holds the paper feeding apparatus with an exterior housing of the image forming apparatus so as to enable the paper feeding apparatus to move into/from the exterior housing of the image forming apparatus, is provided for an exterior wall face of the paper feeding apparatus, and wherein the engaging-holding member is provided for a specific one of the exterior wall faces of the paper feeding apparatus corresponding to the moving direction determined according to the specification of the image forming apparatus.

10 Claims, 7 Drawing Sheets

PAPER FEEDING APPARATUS

CROSS-NOTING PARAGRAPH

This Nonprovisional application claims priority under 35 U.S.C. §119(a) on Patent Application No. 2007-117098 filed in JAPAN on Apr. 26, 2007, the entire contents of which are hereby incorporated herein by references.

FIELD OF THE INVENTION

The present invention relates generally to a paper feeding apparatus, and, more particularly, to a paper feeding apparatus that accumulates paper sheets to form images thereon using an image forming apparatus and that is used being attached to the main body of the image forming apparatus.

BACKGROUND OF THE INVENTION

An image forming apparatus is prevailing that forms images on paper sheets using toner or ink based on image data. Such image forming apparatuses has two types thereof that are a multifunction apparatus referred to as MFP (Multifunction Peripheral) and a single-function apparatus represented by a printer or a facsimile machine. The multifunction apparatus includes a plurality of functions such as a scanner function, a printer function, a facsimile function, and has a function of forming images on recording paper sheets based on image data such as image data read by a scanner, image data transmitted by facsimile, or image data input from an external apparatus such as a PC. A single-function apparatus such as a printer or a facsimile machine has a function of forming images on recording paper sheets based on input image data.

Conventionally, the multifunction apparatus and the single-function apparatus respectively having the above image forming functions each have independently been developed and manufactured. A user knows well about how the user should handle each of the apparatuses and prepares the consumables (toner, a photosensitive body, etc.) to operate each of the apparatuses, and replaces these consumables taking care to avoid confusing these consumables when necessary.

The development of the two types of apparatus is executed handling the apparatuses as different products due to the frame configurations thereof because, in the development process thereof, for the multifunction apparatus and the single-function apparatus, though the layout and the functions of the main portion (for example, a printing processing portion) insides the apparatuses are same, the manners of replenishing paper sheets and replacing consumables or the direction of making accesses to the apparatus when a trouble is coped with are different.

For example, for an MFP, a document reading apparatus is disposed in the uppermost portion of the MFP and, therefore, the strength of the frame of the MFP needs to be increased compared to that of a printer. Furthermore, the MFP employs a front accessing scheme of accessing the MFP from the front face thereof and, therefore, the development of the mechanism is executed such that replenishing work of paper sheets and replacing work of consumables can be executed from the front face of the MFP. For a printer, the mechanism thereof is developed such that paper sheets can be replenished from the side face thereof and replacing work of consumables can be executed from the top face thereof.

FIGS. 7A and 7B are explanatory diagrams of the difference in the accessing scheme between a multifunction apparatus such as an MFP and a single-function apparatus such as a printer. FIG. 7A is an explanatory diagram of the apparatus configuration and the accessing scheme of the MFP. FIG. 7B is an explanatory diagram of the apparatus configuration and the accessing scheme of the printer.

In an image forming apparatus such as an MFP 100 or a printer 200, the apparatus needs to be opened and closed in opportunities other than those for maintenance of the apparatus. The opportunities include, for example, those for replenishing paper sheets when paper sheets stored in a paper feeding portion (a paper feeding apparatus) 103 are insufficient and for replenishing toner used as consumable in a printing processing portion when the toner is insufficient (replacing a toner box).

For the MFP 100 and the printer 200, due to the difference in the originating concept between the two, most of MFPs (a developed model from a single-function copying machine) often employ the front accessing scheme of accessing the apparatus from the front face, and are adapted to be executed to replacement of the consumables thereof and replenishment of the paper sheets thereof from the front face thereof.

In this case, as shown in FIG. 7A, the MFP 100 employs the configuration that an access to a printing processing portion 102 disposed under a paper sheet ejecting portion 101 and an access to the paper feeding portion 103 disposed further under the printing processing portion 102 are made from the front face of the MFP 100. In this case, replacement of the consumables such as toner is executed to the printing processing portion 102 and replenishment of paper sheets is executed to the paper feeding portion 103.

On the other hand, the printer 200 includes no document reading portion and is adapted to print image data sent from a terminal apparatus connected to a communication line. The printer has been developed based on the concept of "being compact" and "being a desktop type" from the first stage of the development of the apparatus. Based on these factors, as shown in FIG. 7B, an accessing scheme is employed that paper sheets are replenished to the paper feeding portion 203 from the side face of the printer 200, and the paper feeding portion 201 is opened and consumables are replaced for the printing processing portion 202 from the top side of the printer 200.

Regarding a paper feeding apparatus applied to the above image forming apparatus, for example, Japanese Laid-Open Patent Publication No. 61-60534 discloses a paper feeding apparatus of a copying machine that has a copying machine main body including a main paper feeding apparatus and a cabinet loading the copying machine main body thereon, wherein an auxiliary paper feeding apparatus is detachably provided for the cabinet, and wherein a paper feeding cassette that can be inserted and removed from the front face of the copying machine is detachably provided to each of the auxiliary paper feeding apparatus and the main paper feeding apparatus.

In a type of the above image forming apparatus, the main portion of the apparatus (for example, the printing processing portion and an optical unit) is used commonly by the multifunction apparatus and the single-function apparatus. However, even though these apparatuses each include a main portion having the same printing characteristic, each of the apparatuses needs to be independently developed and designed because the accessing scheme to the apparatus is different depending on whether the apparatus is the multifunction apparatus or the single-function apparatus.

In this case, in the multifunction apparatus and the single-function apparatus respectively represented by the MFP 100 and the printer 200, because the multifunction apparatus and the single-function apparatus respectively have accessing schemes being different from each other, the term for development thereof is extended, and because the apparatuses respectively have component arrangements thereof being different from each other considering the safety during the development of the apparatuses (such as improvement of printing quality and stability of paper sheet transportation), the apparatuses (MFP/printer) are supplied at high costs.

However, in this case, when standardization of the constituting components of apparatus such as members and parts is possible, reduction of the cost can be facilitated by reducing the term for the development and improvement of the operability of the apparatuses can also be facilitated.

For the above problem, a paper feeding apparatus disclosed in the above Japanese Laid-Open Patent Publication No. 61-60534 is merely an apparatus for which a paper feeding cassette thereof is adapted to be inserted and removed from the front face of the apparatus for each of the main paper feeding apparatus and the auxiliary paper feeding apparatus thereof. Therefore, the above publication does not disclose any technical idea that rationalization is facilitated by standardizing the constituting members for the above apparatuses respectively employing accessing schemes that are different from each other.

SUMMARY OF THE INVENTION

An object of the present invention is to provide, as to paper feeding apparatuses respectively employing accessing schemes that are different from each other of an image forming apparatus, a paper feeding apparatus of an image forming apparatus, that has the configuration to enable the apparatus to be usable regardless of the accessing scheme thereof and that is adapted to facilitate cost reduction by reducing the term of development of the apparatus and improve the operability of the apparatus.

Another object of the present invention is to provide a paper feeding apparatus used in a state where the apparatus accumulates paper sheets for an image forming apparatus to form images thereon and the paper feeding apparatus is attached to a main body of the image forming apparatus, wherein an engaging-holding member is provided for an exterior wall face of the paper feeding apparatus, and the engaging-holding member engages and holds the paper feeding apparatus with an exterior housing of the image forming apparatus so as to enable the paper feeding apparatus to move into/from the exterior housing of the image forming apparatus, is provided for an exterior wall face of the paper feeding apparatus, and wherein the engaging-holding member is provided for a specific one of the exterior wall faces of the paper feeding apparatus corresponding to the moving direction determined according to the specification of the image forming apparatus.

Another object of the present invention is to provide the paper feeding apparatus, wherein the engaging-holding member is provided for the exterior wall face that is parallel to the moving direction, of the exterior wall faces of the paper feeding apparatus.

Another object of the present invention is to provide the paper feeding apparatus, wherein the paper feeding apparatus integrally comprises a paper sheet accumulating portion that accumulates the paper sheets, and a paper sheet transporting path that constitutes a portion of a transporting path that transports one by one the paper sheets accumulated in the paper sheet accumulating portion.

Another object of the present invention is to provide the paper feeding apparatus, wherein an image forming apparatus that has a different moving direction is an MFP (Multifunction Peripheral) that is a multifunction apparatus, or a printer that is a single-function apparatus, and wherein the paper feeding apparatus is provided with the engaging-holding member corresponding to the moving direction of either the MFP or the printer.

Another object of the present invention is to provide the paper feeding apparatus, wherein the moving direction of the MFP is a direction forward and backward of an MFP employing a front accessing scheme.

Another object of the present invention is to provide the paper feeding apparatus, wherein the engaging-holding member is provided for the side exterior wall face of the paper feeding apparatus that moves forward and backward and engages and holds the side exterior wall face of the paper feeding apparatus with an exterior housing of the MFP.

Another object of the present invention is to provide the paper feeding apparatus, wherein the moving direction of the printer is a direction rightward and leftward of a printer employing a side accessing scheme.

Another object of the present invention is to provide the paper feeding apparatus, wherein the engaging-holding member is provided for the front exterior wall face of the paper feeding apparatus that moves rightward and leftward and engages and holds the front exterior wall face of the paper feeding apparatus with an exterior housing of the printer.

Another object of the present invention is to provide the paper feeding apparatus, wherein the engaging-holding member is a slide rail formed by mutually movably assembling a plurality of rail.

Another object of the present invention is to provide the paper feeding apparatus, wherein the paper feeding apparatus comprises a supporting member on a bottom wall of the paper feeding apparatus to support the paper feeding apparatus, and wherein the supporting member moves inside the main body of the image forming apparatus while supporting the paper feeding apparatus when the paper feeding apparatus moves in the moving direction.

Another object of the present invention is to provide the paper feeding apparatus, wherein the supporting member is disposed around the inside of the intersection of the plurality of exterior wall faces of the paper feeding apparatus, and wherein the plurality of exterior wall faces are a plurality of exterior wall faces positioned respectively on the opposite sides of the plurality of exterior wall faces that can each be a fitting position of the engaging-holding member determined according to the specification of the image forming apparatus.

Another object of the present invention is to provide the paper feeding apparatus, wherein the supporting member is roller that can freely rotate forward, backward, rightward and leftward.

Another object of the present invention is to provide the paper feeding apparatus, wherein the supporting member is a sliding member that slides on the main body of the image forming apparatus.

PREFERRED EMBODIMENTS OF THE INVENTION

Figure 1:
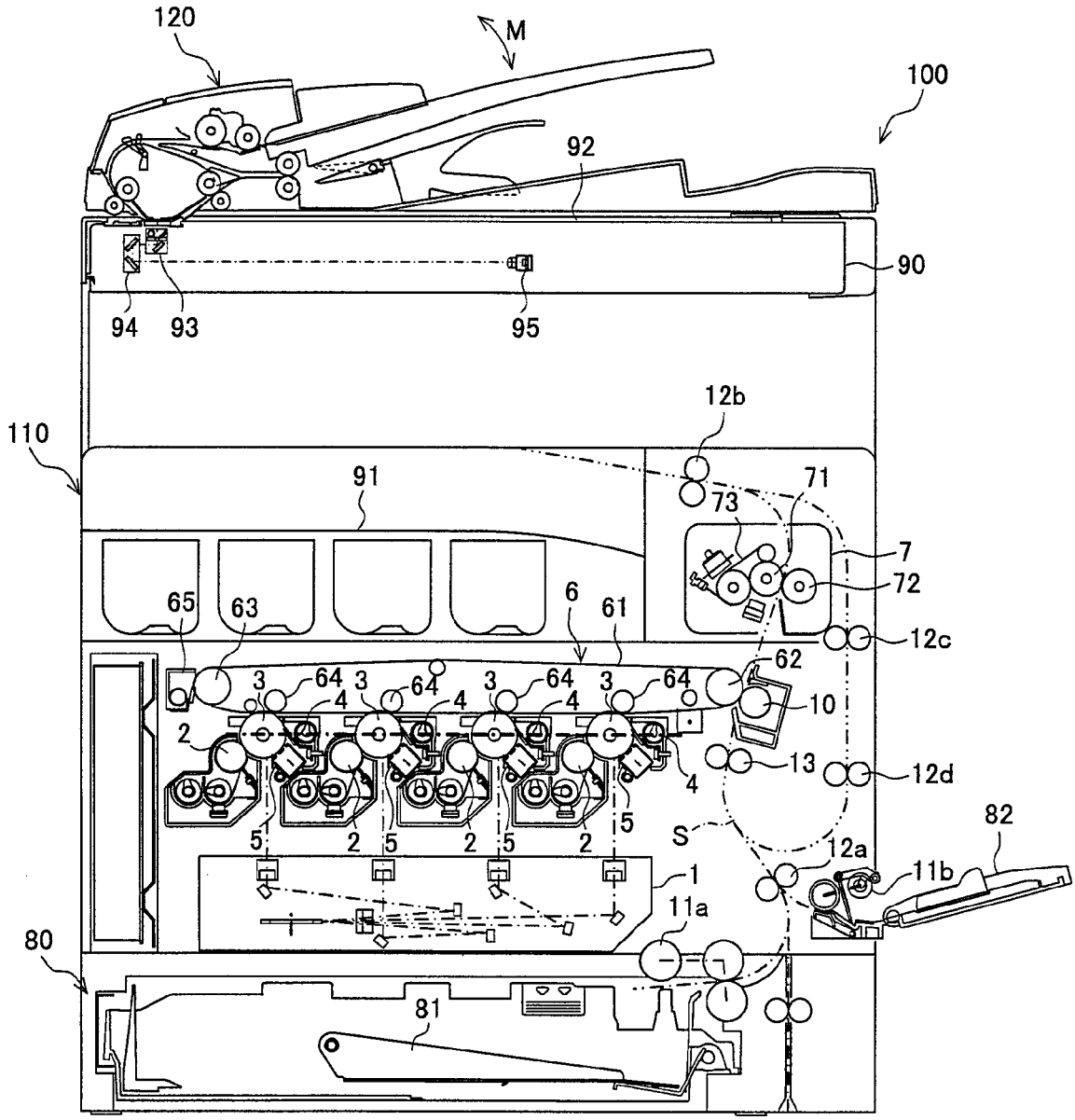
FIG. 1 is a diagram of an exemplary configuration of an MFP (multifunction peripheral) to which a paper feeding apparatus of the present invention is applied.

FIG. 1 is a diagram of an exemplary configuration of an MFP (multifunction peripheral) to which a paper feeding apparatus of the present invention is applied. An MFP 100 forms a color or monochrome image onto a predetermined sheet (recording paper sheet) according to image data transmitted externally. The MFP 100 is configured by an apparatus main body 110 and an automatic document processing apparatus 120. The apparatus main body 110 is configured by having an exposure unit 1, a developer 2, a photo-sensitive drum 3, a cleaner unit 4, an electric charger 5, an intermediate transferring belt unit 6, a fixing unit 7, a paper feeding cassette 81, a paper sheet receiving tray 91, etc.

On the top of the apparatus main body 110, a document loading base 92 consisting of a transparent glass plate on which a document is loaded is provided, and the automatic document processing apparatus 120 is attached above the document loading base 92. The automatic document processing apparatus 120 automatically transports a document onto the document loading base 92. The automatic document processing apparatus 120 is adapted to freely rotate in the direction of an arrow M, and a document can be manually put by opening the portion on the document loading base 92.

A scanner apparatus 90 has an automatic reading mode of automatically supplying documents each in a sheet-like shape using the automatic document processing apparatus 120 and reading document images by exposing and scanning the documents sequentially one after another and a manual reading mode of setting using a manual operation a document in a book-like shape or a document in a sheet-like shape that the automatic document processing apparatus 120 can not automatically supply and reading a document image. A first scanning unit 93 and a second scanning unit 94 that move along the document loading base 92 mutually maintaining a predetermined relation of the speed thereof expose and scan an image of the document set on the transparent document loading base 92, and the image is guided by optical parts such as a mirror and an image focusing lens and is focused on a photoelectric converting element 95. Thereby, the image of the document is converted into an electric signal and the signal is output. The scanner apparatus 90 and the automatic document processing apparatus 120 constitute a document reading apparatus.

Image data handled in the present image forming apparatus corresponds to a color image produced using colors of black (K), cyan (C), magenta (M), and yellow (Y). Therefore, four units of each of the developer 2, the photo-sensitive drum 3, the electric charger 5, and the cleaner unit 4 are provided such that four types of latent image are formed respectively corresponding to the colors, and the four units of the components are respectively set for black, cyan, magenta, and yellow, and the four sets of components respectively configure four image stations.

The electric charger 5 is a charging means to charge the surface of the photo-sensitive drum 3 evenly at a predetermined potential, and a roller-type one or a brush-type one that are contacting-type ones may be used in addition to the charger-type one shown in FIG. 1.

The exposure unit 1 corresponds to an image writing apparatus related to the present invention and is configured as a laser scanning unit (LSU) that includes a laser emitting portion, a reflecting mirror, etc. The exposure unit 1 is disposed therein with a polygon mirror that scans a laser beam and optical elements such as a lens and a mirror to guide the laser beam reflected by the polygon mirror to the photo-sensitive drum 3. In addition, the exposure unit 1 may employ an approach of using, for example, an EL or LED writing head formed by arranging light emitting elements in an array.

The exposure unit 1 has a function of exposing the photo-sensitive drum 3 that is charged, corresponding to an input image data and, thereon, forming an electrostatic latent image corresponding to the image data. The developer 2 develops as an image the electrostatic latent image formed on each of the photo-sensitive drums 3 using toners respectively having four colors (YMCK). The cleaner unit 4 removes and collects the toner remaining on the surface of each photo-sensitive drum 3 after the development and the image transfer.

The intermediate transferring belt unit 6 disposed above the photo-sensitive drum 3 includes an intermediate transferring belt 61, an intermediate transferring belt driving roller 62, an intermediate transferring belt following roller 63, an intermediate transferring roller 64, and an intermediate transferring belt cleaning unit 65. Four units of the intermediate transferring roller 64 are provided respectively corresponding to the colors of YMCK.

The intermediate transferring belt driving roller 62, the intermediate transferring belt following roller 63, and the intermediate transferring roller 64 support the intermediate transferring belt 61 under a tension and drives the intermediate transferring belt 61 to rotate. Each intermediate transferring roller 64 provides a transfer bias to transfer the toner image on the photo-sensitive drum 3 onto the intermediate transferring belt 61.

The intermediate transferring belt 61 is provided such that the intermediate transferring belt 61 contacts each photo-sensitive drum 3, and the intermediate transferring belt 61 has a function of forming a color toner image (multi-color toner image) on the intermediate transferring belt 61 by transferring the toner images respectively of the colors formed on the photo-sensitive drums 3 onto the intermediate transferring belt 61, superimposing sequentially. The intermediate transferring belt 61 is formed in an endless shape using, for example, a film having a thickness of about 100 to 150 μm.

The transfer of the toner image from the photo-sensitive drum 3 to the intermediate transferring belt 61 is executed by the intermediate transferring roller 64 that contacts the back side of the intermediate transferring belt 61. The intermediate transferring roller 64 is applied with a transfer bias of a high voltage (a high voltage of the opposite polarity (+) of the charging polarity (−) of the toner) to transfer the toner image. The intermediate transferring roller 64 is a roller formed by a shaft formed of a metal (for example, stainless steel) and having a diameter of 8 to 10 mm as the base thereof, and an electro-conductive elastic material (for example, EPDM or urethane foam) covering the surface of the shaft. Due to this electro-conductive elastic material, a high voltage can be evenly applied to the intermediate transferring belt 61. In the embodiment, though a roller-like shape is employed as the shape of a transferring electrode, a brush-like shape may be used, in addition.

Each electrostatic latent image that has been developed as an image corresponding to each color tone on each photo-sensitive drum 3 as above is accumulated on the intermediate transferring belt 61. In this manner, the accumulated image information transferred onto a paper sheet by a transferring roller 10 that is disposed at a contact position described later of the paper sheet and the intermediate transferring belt 61 by the rotation of the intermediate transferring belt 61.

At this time, the intermediate transferring belt 61 and the transferring roller 10 are pressed into contract by a predetermined nip and the transferring roller 10 is applied with a voltage to transfer the toner onto the paper sheet (a high voltage having the opposite polarity (+) of the charged polarity (−) of the toner). As to the transferring roller 10, to constantly obtain the above nip, one of the transferring roller 10 or the intermediate transferring belt driving roller 62 is formed from a hard material (such as a metal) and a soft material such as an elastic roller (an elastic rubber roller or a resin foam roller, etc.) for the other roller.

Toner that adheres to the intermediate transferring belt 61 by contacting the photo-sensitive drum 3 as above, or toner that remains on the intermediate transferring belt 61 because the transfer has not been executed onto the paper sheet by the transferring roller 10, is the causes to occur color mixing of the toner at the next process step. Therefore, the apparatus is designed to remove and collect the above toner using the intermediate transferring belt cleaning unit 65. The intermediate transferring belt cleaning unit 65 includes, for example, a cleaning blade as a cleaning member that contacts the intermediate transferring belt 61, and the intermediate transferring belt 61 that the cleaning blade contacts is supported by the intermediate transferring belt following roller 63 from the back side thereof.

The MFP 100 includes therebeneath a paper feeding apparatus 80 to accumulate recording paper sheets and feed the sheets. The paper feeding apparatus 80 is provided with a paper feeding cassette 81 to accumulate sheets (recording paper sheets) to be used for forming images. This paper feeding cassette 81 is provided for the exposure unit 1 thereunder of the apparatus main body 110. The sheets to be used for forming images can also be put in a manual-insertion paper feeding cassette 82. The paper sheet receiving tray 91 that is provided for the apparatus main body 110 thereon is a tray to accumulate printed sheets face down.

The apparatus main body 110 is also provided with a paper sheet transporting path S having an approximately upright shape, to send the sheets in the paper feeding cassette 81 and the manual-insertion paper feeding cassette 82 to the paper sheet receiving tray 91 through the transferring roller 10 and the fixing unit 7. In the vicinity of the paper sheet transporting path S from the paper feeding cassette 81 or the manual-insertion paper feeding cassette 82 to the paper sheet receiving tray 91, picking-up rollers 11*a* and 11*b*, a plurality of transporting roller 12*a* to 12*d*, a resist roller 13, the transferring roller 10, the fixing unit 7, etc., are disposed.

The transporting rollers 12*a* to 12*d* are small rollers to facilitate and aid the transportation of the sheets and the plurality thereof is provided along the paper sheet transporting path S. The picking-up roller 11*a* is disposed in the vicinity of the end of the paper feeding cassette 81, and picks up the sheets one by one from the paper feeding cassette 81 and supplies the sheets to the paper sheet transporting path S. Similarly, the picking-up roller 11*b* is disposed in the vicinity of the end of the manual-insertion paper feeding cassette 82, and picks up the sheets one by one from the manual-insertion paper feeding cassette 82 and supplies the sheets to the paper sheet transporting path S.

The resist roller 13 momentarily retains the sheet that is being transported in the paper sheet transporting path S, and has a function of transporting the sheet to the transferring roller 10 at the timing at which the heading edge of the toner image on the photo-sensitive drum 3 meets the heading edge of the sheet.

The fixing unit 7 includes a heating roller 71 and a pressuring roller 72. The heating roller 71 and the pressuring roller 72 are adapted to rotate sandwiching the sheet therebetween. The heating roller 71 is designed to be at a predetermined fixing temperature by a controlling portion based on a signal from a temperature detector not shown. The heating roller 71 has a function of melting, mixing, and pressure-welding a multi-color toner image that has been transferred onto the sheet and heat-fixing this image onto the sheet by, together with the pressuring roller 72, thermo-compression-bonding the toner onto the sheet. An external heating belt 73 to externally heat the heating roller 71 is provided.

The sheet transporting path will be described in detail. As above, the image forming apparatus is provided with the paper feeding apparatus 80 having the paper feeding cassette 81 that accumulates in advance the sheets, and the manual-insertion paper feeding cassette 82. To feed the paper sheets from these paper feeding cassettes 81 and 82, each of the picking-up rollers 11*a* and 11*b* is disposed and is adapted to guide the sheets one by one to the transporting path S.

The sheet transported from each of the paper feeding cassettes 81 and 82 is transported by the transporting roller 12*a* of the paper sheet transporting path S to the resist roller 13 and is transported to the transferring roller 10 at the timing at which the heading edge of the sheet meets the heading edge of image information on the intermediate transferring belt 61, and the image information is written onto the sheet. Thereafter, the sheet passes through the fixing unit 7 and, thereby, the unfixed toner on the sheet is thermally melted and fixed. The sheet passes through the transporting roller 12*b* disposed thereafter and is ejected onto the paper sheet receiving tray 91.

The above transporting path is the one for coping with a request for single-side printing to the sheets. However, in contrast, when a request for double-side printing is issued, when the tailing edge of the sheet that has finished being single-side printed as above and has passed through the fixing unit 7 is grabbed by the transporting roller 12*b* disposed lastly, the transporting roller 12*b* rotates in the reverse direction and, thereby, guides the sheet to the transporting rollers 12*c* and 12*d*. Thereafter, the sheet passes through the resist roller 13 and printing is executed on the back side of the sheet. Thereafter, the sheet is ejected into the paper sheet receiving tray 91.

The MFP 100 shown in FIG. 1 has a plurality of function such as, for example, a copying function, a printer function, a facsimile function, and the MFP 100 can read the image of a document and can print and output the image data that has been read. The MFP 100 can transmit the read image data to external apparatuses such as a PC through a network such as a LAN or a public line network.

The MFP 100 further can operate independently solely by the apparatus itself, and is adapted to facilitate improvement of efficiency of the printing processing thereof by expanding the functions of the MFP 100 by attaching thereto an apparatus such as a large-capacity paper feeding cassette, a post-process apparatus, or a large-capacity paper sheet receiving tray.

Figure 2:
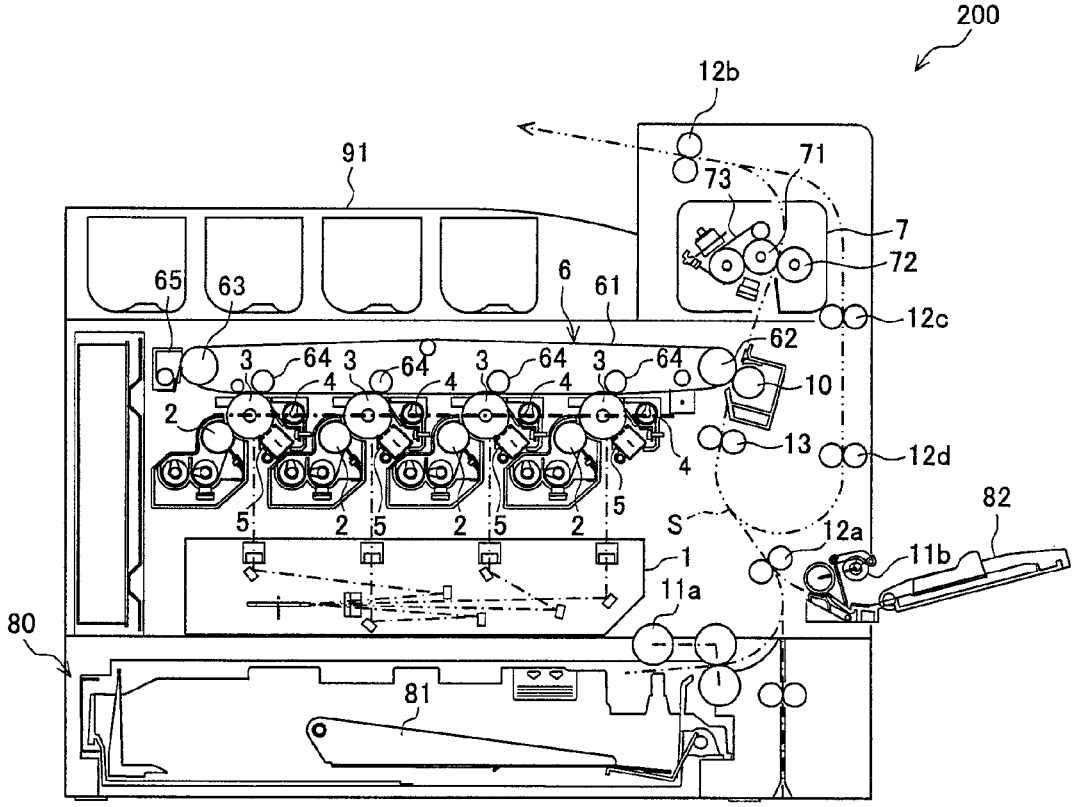
FIG. 2 is a diagram of an exemplary configuration of a printer to which a paper feeding apparatus of the present invention is applied.

FIG. 2 is a diagram of an exemplary configuration of a printer to which a paper feeding apparatus of the present invention is applied.

As shown in FIG. 2, a printer 200 of the example includes the same configuration as that of the MFP 100 except that the printer 200 does not include the document reading apparatus configured by the automatic document reading apparatus 120 and the scanner apparatus 90 of the above MFP 100. In this case, the components that have the same functions as those of the MFP 100 of FIG. 1 are given the same reference numerals as those of FIG. 1 and repeated description for these components is omitted because these components execute the same operations in both of the printer 20*b* and the MFP 100.

Figure 3A:
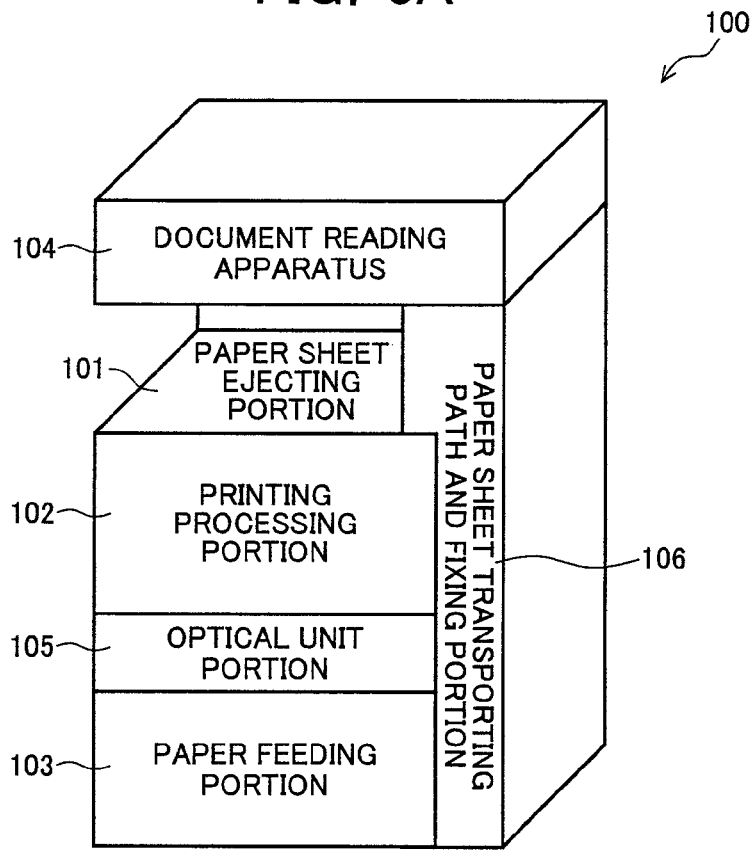
FIGS. 3A and 3B are schematic explanatory diagrams of the configurations respectively of the MFP and the printer shown respectively in the above figures.
Figure 3B:
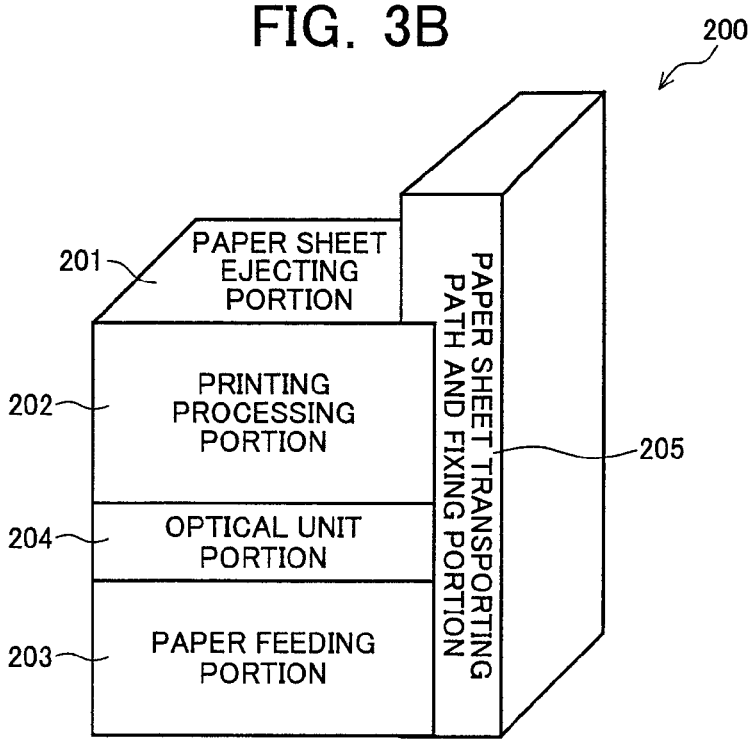

FIGS. 3A and 3B are schematic explanatory diagrams of the configurations respectively of the MFP and the printer shown in the above example. FIG. 3A is a diagram of the schematic configuration of the MFP. FIG. 3B is a diagram of the schematic configuration of the printer.

Due to the recent shift to multi-function apparatuses of image forming apparatuses, a plurality of apparatus to add the functions are disposed around the image forming apparatus and, therefore, the size of an image forming apparatus is being increased. In this context, many types of image forming apparatus have been developed that seek convenience of users as the image forming apparatus itself solely, by employing the front accessing scheme by the build up scheme.

As shown in FIG. 3A, the MFP 100 is disposed with a paper feeding portion 103 at the bottommost portion thereof. The paper feeding portion 103 corresponds to the paper feeding apparatus according to the present invention, and is an apparatus to normally prepare a type of paper sheets that is most frequently used, selected from a plural types of paper sheet that are considered to be standard types among the types of paper sheet that the image forming apparatus can form images thereon. For example, the paper feeding portion 103 is adapted to be able to store about 300 to 1,000 sheets having the sizes of A4, B4, A3, etc.

On the side of the paper feeding portion 103, a paper sheet transporting path (generally "main transporting path") that transports the paper sheets to be stored in the paper feeding portion 103 to printing processing portion 102 during a printing processing process, and a fixing portion that fixes unfixed toner on the paper sheet are disposed (the paper sheet transporting path and the fixing portion 106).

A document reading apparatus 104 is disposed in the uppermost portion of the MFP 100. The document reading apparatus 104 has two types thereof of a document-fixed reading apparatus having a moving-type optical unit (a light source, a reflecting mirror, a through lens, and a CCD), and a document-moving reading apparatus that has a fixed optical unit and that employs a scheme of moving a document. A recent document reading apparatus is provided with the above two types of document reading apparatus in parallel.

On the paper feeding portion 103, an optical unit portion 105 for printing images is disposed to image-process image data read by the document reading apparatus 104 or image data received from a terminal apparatus through a network into a printed image in the control portion and write the image information into the printing processing portion.

Immediately on the optical unit portion 105 for printing images, the printing processing portion 102 is disposed having a photo-sensitive body, a developing tank, and an intermediate transferring belt as the main component thereof. The image information written on the intermediate transferring belt (that has been developed into an image using toner) is transferred onto a paper sheet that is being transported through the main transporting path by a transferring portion of the printing processing portion 102. The above fixing portion disposed downstream in the paper sheet transporting direction of the transferring portion melts and fixes the unfixed toner and the paper sheet is adapted to be ejected into the paper sheet ejecting portion 101.

On the other hand, the printer 200 shown in FIG. 3B, similarly to the above MFP 100, has the paper sheet ejecting portion 201, the printing processing portion 202, the paper feeding portion 203, an optical unit portion 204, a paper sheet transporting path, and a fixing portion 205. The functions of these components are same as that of the components of the above MFP 100.

The printer 200 does not have any document reading apparatus that the MFP 100 includes and, therefore, is adapted to not be able to obtain image data by reading the document image data. In this case, the printer 200 is an image forming apparatus that mainly includes the function of print-processing the image data transmitted from each terminal apparatus (such as a computer) on a network.

In the embodiment according to the present invention, the MFP exerts to the maximum the characteristics of the MFP itself and the printer exerts to the maximum the characteristics of the printer itself and, simultaneously, the paper feeding apparatus that can be applied commonly to both of the apparatuses is used. Thereby, reduction of the apparatus cost, improvement of compatibility of the paper feeding mechanism, and improvement of the user operability can be facilitated due to reduction of the development schedule of both of the apparatuses, and reduction of the number of parts by simplification of the paper feeding apparatus and the paper sheet transporting path.

Description will be given in further detail for an exemplary configuration of the paper feeding apparatus that is made common to the multifunction apparatus and the single-function apparatus.

Figure 4A:
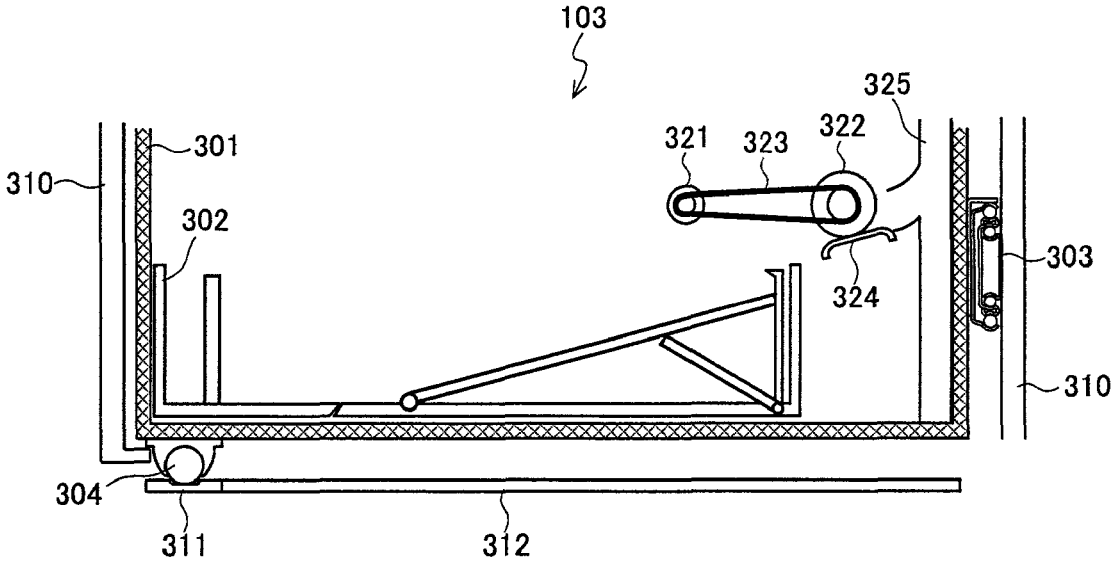
FIGS. 4A and 4B are diagrams of the schematic configuration of an embodiment of the paper feeding apparatus according to the present invention.
Figure 4B:
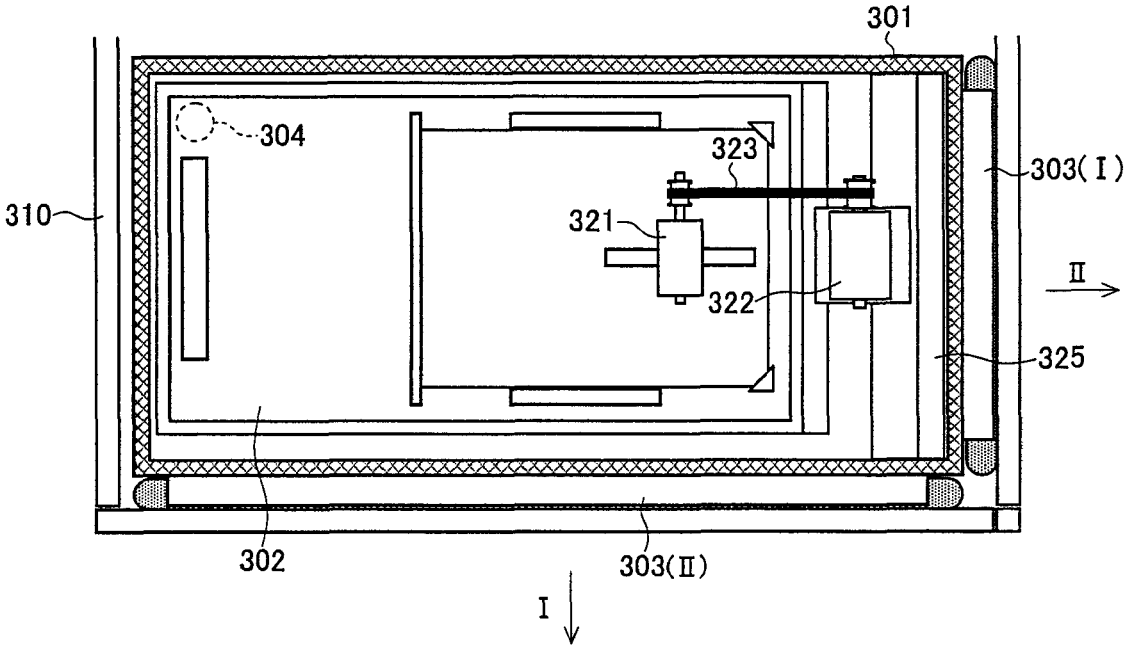

FIGS. 4A and 4B are diagrams of a schematic configuration of an embodiment of the paper feeding apparatus according to the present invention. FIG. 4A is a schematic side view of the paper feeding apparatus. FIG. 4B is a schematic plain view of the paper feeding apparatus. In FIGS. 4A and 4B, "301" denotes a frame body of the paper feeding apparatus, "302" denotes a paper feeding cassette, "303" denotes a slide rail, "304" denotes a roller, "310" denotes an apparatus exterior housing, "311" denotes an MFP roller receiving seat groove portion, "312" denotes a printer roller receiving seat groove portion, "321" denotes a paper feeding roller, "322" denotes a paper sheet handling roller, "323" denotes a driving belt, "324" denotes a paper sheet handling plate and "325" denotes a paper sheet transporting path. The paper feeding cassette 302 corresponds to the paper feeding cassette 81 of FIGS. 1 and 2.

The paper feeding cassette 302 is disposed inside the frame body 301 of the paper feeding apparatus, and accumulates recording paper sheets to form images thereon using the image processing portion of the image forming apparatus. The paper feeding roller 321 that picks up the recording paper sheets one by one from the paper feeding cassette, the paper sheet handling roller 322 that sends the recording paper sheets picked up by the paper feeding roller 321 into the paper sheet transporting path 325, the paper sheet handling plate 324 to guide the recording paper sheets in the direction toward the transporting path by contacting the paper sheet handling roller 322, and the driving belt 323 to transmit to the paper feeding roller 321 the driving operation of the paper sheet handling roller connected to a driving shaft are disposed as a paper feeding unit to send the recording paper sheets accumulated in the paper feeding cassette 302 into the paper sheet transporting path 325. This paper feeding unit is attached and fixed to the main body of the image forming apparatus, and is configured separately from the paper feeding apparatus.

According to the conventional configuration, the paper feeding cassette 302 that is detachable from the image forming apparatus and the paper sheet transporting path 325 for which a removal work of paper sheets can be executed when the transported paper sheets are jammed, are disposed respectively as separate configurations. The inside of the paper sheet transporting path 325 can be observed by opening and closing operations of the side exterior wall face of the image forming apparatus and the jammed paper sheets can be removed.

The embodiment of the present invention is configured by integrally disposing the paper feeding cassette 302 and the paper sheet transporting path 325 inside the frame body 301 of the paper feeding apparatus. The paper feeding cassette 302 corresponds to the paper sheet accumulating portion of the present invention that accumulates the paper sheets to form images thereon. The paper sheet transporting path 325 constitutes a portion of the transporting path that transports the paper sheets accumulated in the paper feeding cassette 302 one by one to the image processing portion.

The driving unit including the paper feeding roller 321, the paper sheet handling roller 322, the paper sheet handling plate 324, the driving belt 323, etc., that is fixed to the main body of the image forming apparatus is configured as a component separate from the paper feeding apparatus similarly to the conventional configuration.

A characteristic of the embodiment of the present invention can be that the paper feeding apparatus that integrally configures the paper feeding cassette 302 and the paper sheet transporting path 325 as above is adapted to be able to be used commonly to a multifunction apparatus such as an MFP and a single-function apparatus such as a printer. That is, for example, for the MFP and the printer, a common paper feeding apparatus is adapted to be disposed at the same position therein.

In this case, because the accessing scheme is different between the multifunction apparatus such as an MFP and the single-function apparatus such as a printer as above, to support either of the two, the embodiment of the present invention is configured such that the slide rail 303 is fitted between the exterior wall face of the frame body 301 of the paper feeding apparatus and the image forming apparatus exterior housing 310, the frame body 301 of the paper feeding apparatus is supported by the slide rail 303, and the frame body 301 can be moved forward and backward by sliding the rail 301 corresponding to the accessing direction. The apparatus exterior housing 310 is an exterior housing member included in the image forming apparatus main body.

In the embodiment, the slide rail 303 is fitted to either one of the exterior housing faces of the frame body 301 that are parallel to the moving direction of the frame body 301.

That is, for explanation, FIG. 4B shows a configuration according to which slide rails 303 (303(I) and 303 (II)) are provided for the frame body 301 on both of the front exterior wall face and the right side exterior wall face thereof. However, in practice, the slide rail 303 is provided for either one position along the direction that the frame body 301 is slid in and, thereby, is moved forward and backward.

This slide rail 303 corresponds to engaging-holding member of the present invention that engages with and holds the paper feeding apparatus such that the paper feeding apparatus can move into/from the exterior housing 310 of the image forming apparatus. That is, the characteristic is that, in the embodiment, the slide rail 303 is fitted on the exterior wall face of the frame body 301 that corresponds to the exterior wall face of the paper feeding apparatus, as the engaging-holding member that engages with and holds the paper feeding apparatus such that the paper feeding apparatus can move into/from the exterior housing 310 of the image forming apparatus, and the slide rail 303 is fitted to a specific one of the exterior wall faces of the paper feeding apparatus, corresponding to the moving direction of the paper feeding apparatus determined according the specification of the image forming apparatus.

For example, for the MFP, because the front accessing scheme of accessing from the front face is employed, the frame body 301 of the paper feeding apparatus can be pulled out by sliding the frame body 301 in the direction of an arrow "I" of FIG. 4B. The frame body 301 that has been pulled out can be returned to the original position thereof. That is, the directions respectively toward the front and the back of the MFP are respectively the moving directions of the paper feeding apparatus.

In this case, the slide rail 303 (I) is fitted to the right side wall face of the frame body and the apparatus exterior housing 310 and the frame body 301 are connected through the slide rail 303 (I). In this case, the paper sheet transporting path 325 is integrally provided for the frame body 301 and, therefore, the right side wall of the apparatus exterior housing 310 does not need to be opened and closed and the slide rail 303 may be fitted.

On the other hand, for the printer, the side accessing scheme of accessing the paper feeding apparatus from the side face thereof is employed, the frame body 301 of the paper feeding apparatus can be pulled out by sliding the apparatus in the direction of an arrow "II" of FIG. 4B. The frame body 301 that has been pulled out can be returned to the original position thereof. That is, the directions respectively toward the right and the left of the printer are respectively the moving directions of the paper feeding apparatus.

In this case, the slide rail 303 (II) is fitted to the wall portion (the front wall) on the front side of the frame body and the apparatus exterior housing 310 and the frame body 301 are connected through the slide rail 303 (II). In this case of the side accessing scheme, the front side of the apparatus exterior housing 310 does not need to be opened and closed and, therefore, the slide rail 303 may be fitted.

The roller 304 to maintain the posture of the frame body 301 and enable the smooth moving forward and backward of the paper feeding apparatus is fitted at the bottom wall of the opposite end of the frame body 301 held to the apparatus exterior housing 310 by the slide rail 303.

The roller 304 is provided for the frame body 301 of the paper feeding apparatus on the bottom face deep on the left thereof such that the roller 304 can be applied to both of the sliding direction (the arrow I) for the front accessing scheme and the sliding direction (the arrow II) for the side accessing scheme. The roller 304 is configured by, for example, a sphere that can be rotated in any direction of forward, backward, rightward and leftward and is adapted to function as a roller in either of the above two sliding directions (I and II).

The roller 304 corresponds to the supporting member of the present invention fitted to the bottom wall of the paper feeding apparatus and the supporting member moves inside the main body of the image forming apparatus while supporting the paper feeding apparatus when the paper feeding apparatus moves in a predetermined moving direction or backward direction.

In this case, the roller 304 is disposed around the inside of the intersection of the two exterior wall faces on the left side and on the back side of the frame body 301. These exterior wall faces are the exterior wall faces positioned respectively on the opposite sides of the exterior wall face of the front wall and the exterior wall face on the right side that can be the fitting positions of the slide rail 303. Due to such a configuration, the frame body 301 of the paper feeding apparatus is retained against the apparatus exterior housing 310 by the slide rail 303 fitted on either of the exterior wall faces and the roller 304 fitted on the opposite bottom portion.

That is, the paper feeding apparatus held by the slide rail 303 can be stabilized by further holding the apparatus also by the roller 304 and, therefore, the reliability of the paper feeding operation and the moving forward and backward of the paper feeding apparatus can be improved.

Figure 5:
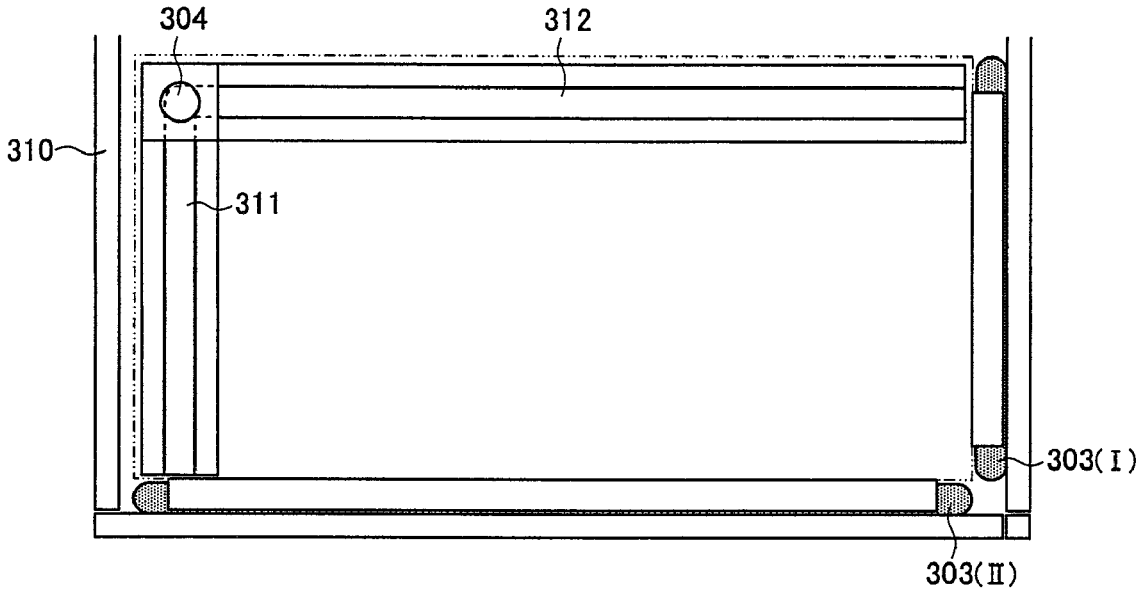
FIG. 5 is a diagram of an exemplary configuration of a receiving seat groove of a roller provided for the exterior housing of the apparatus on the bottom face thereof.

FIG. 5 is a diagram of an exemplary configuration of a receiving seat groove of a roller provided for the exterior housing of the apparatus on the bottom face thereof. As above, an MFP roller receiving seat groove portion 311 to receive the roller 304 and a printer roller receiving seat groove portion 312 are provided for the bottom wall of the apparatus exterior housing 310 that contacts the roller 304.

The MFP roller receiving seat groove portion 311 and the printer roller receiving seat groove portion 312 each have a groove-like shape that guides the roller 304 that rolls with the operation of the main body 301 of moving forward or backward, in the direction of moving forward and backward thereof. As shown, for the MFP roller receiving seat groove portion 311, the groove shape thereof extends in the direction toward the front and the back of the apparatus to cope with an MFP, etc., employing the front accessing scheme. For the printer roller receiving seat groove portion 312, the groove shape thereof extends in the direction rightward and leftward of the apparatus to cope with a printer, etc., employing the side accessing scheme.

The MFP roller receiving seat groove portion 311 and the printer roller receiving seat groove portion 312 may be fitted together on the bottom wall of the exterior housing 310 of the image forming apparatus. However, for the MFP, the image forming apparatus may be the one that includes only the MFP roller receiving seat groove portion 311 and, for the printer, the image forming apparatus may be the one that includes only the printer roller receiving seat groove portion 312.

Figure 6A:
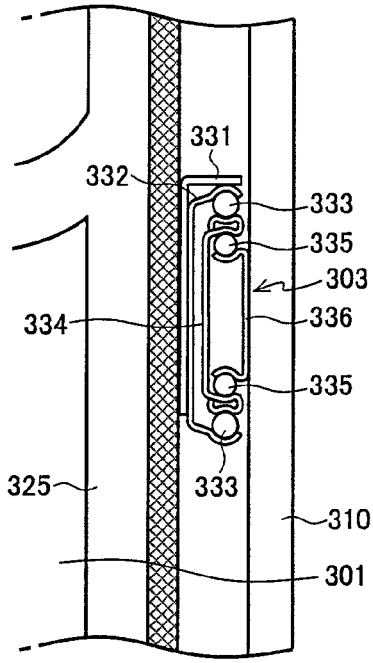
FIGS. 6A and 6B are explanatory diagrams of an exemplary configuration of a slide rail that connects a frame body and a exterior housing of the apparatus.
Figure 6B:
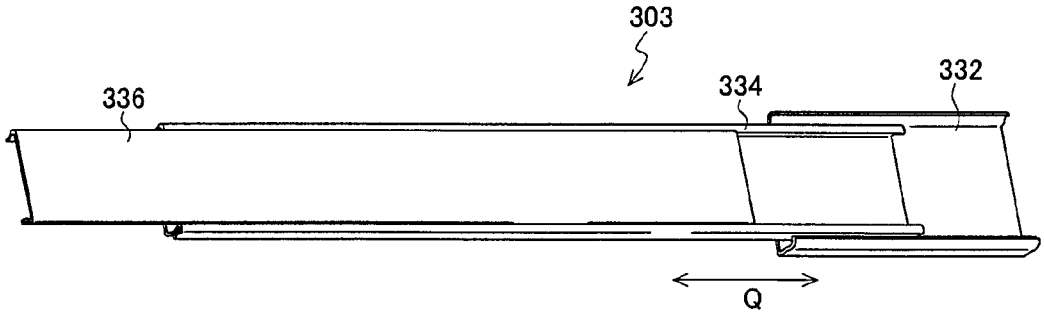
Figure 7B:
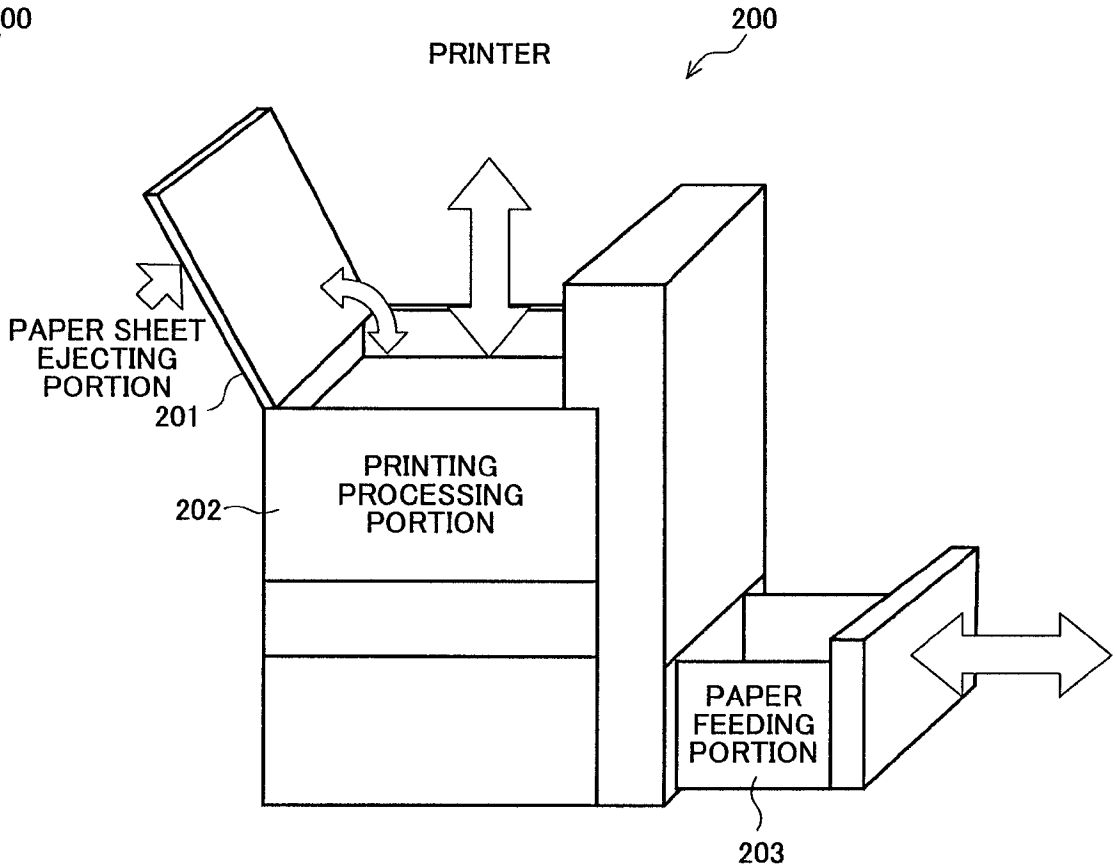
FIGS. 7A and 7B are explanatory diagrams of the difference in the accessing scheme between a multifunction apparatus such as an MFP and a single-function apparatus such as a printer.
Figure 7A:
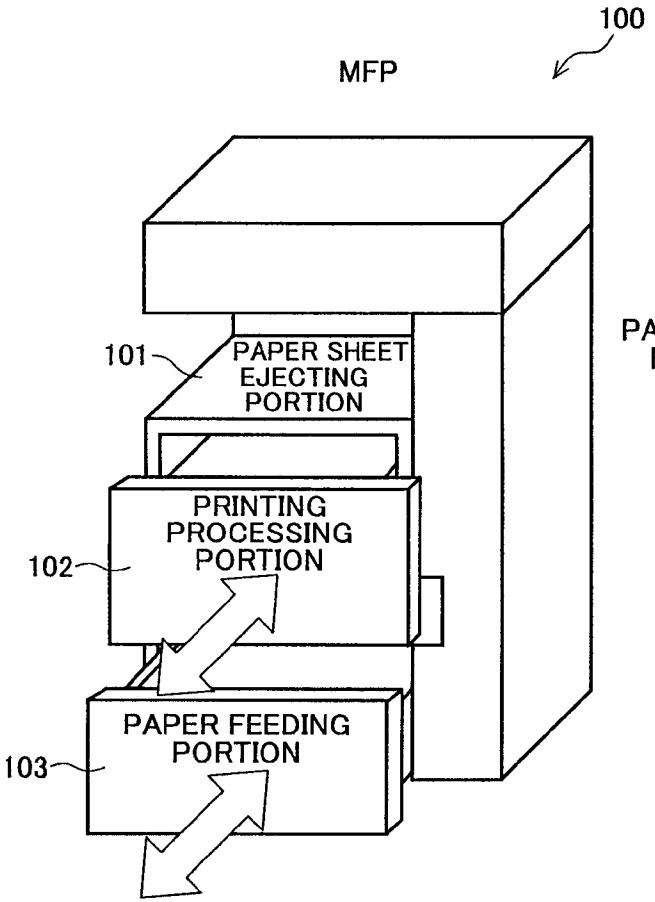

FIGS. 6A and 6B are explanatory diagrams of an exemplary configuration of a slide rail that connects the above frame body 301 and the above apparatus exterior housing 310. FIG. 6A is a schematic side view of the slide rail disposed between the apparatus exterior housing and the frame body of the paper feeding apparatus. FIG. 6B is a schematic perspective view of the slide rail itself solely. In FIGS. 6A and 6B, "303" denotes the slide rail, "331" denotes a fitting angle, "332" denotes an outer rail, "333" and "335" denote steel balls, "334" denotes an intermediate rail (retainer) and "336" denotes an inner rail.

An example of the slide rail 303 can be, as shown, the one for which the outer rail 332, the intermediate rail 334 and the inner rail 336 mutually engage and hold each other sandwiching the steel balls 333 and 335 thereamong. These three rails 332, 334, and 336 can mutually slide in the longitudinal direction thereof due to the action of the steel balls 333 and 335. That is, as shown in FIG. 6B, the slide rail 303 can freely be elongated or shortened in the longitudinal direction thereof (the direction of an arrow Q) due to the three rails 332, 334, and 336 being mutually assembled and slidably configured.

Using the above slide rail 303, for example, the outer rail 332 is fitted to the exterior wall face of the frame body 301 of the paper feeding apparatus using the fitting angle 331. The inner rail 336 of the slide rail 303 is fixed on the interior wall face of the apparatus exterior housing 310. Thereby, the frame body 301 of the paper feeding apparatus is retained on the apparatus exterior housing 310 by the slide rail 303, and the frame body 301 can be slid in the direction perpendicular to the paper sheet of the FIG. 6A. The paper feeding cassette 302 and the paper sheet transporting path 325 are integrally disposed inside the frame body 301 and, therefore, replenishing of paper sheets and removal of jammed paper sheets can be executed by pulling out the frame body 301 sliding the frame body 301 for the time such as when the paper sheets are replenished for the paper feeding cassette 302 of the paper feeding apparatus and when the paper sheets are jammed on the paper sheet transporting path 325.

In this manner, by using the slide rail 303 formed by mutually movably assembling a plurality of rails as an engaging-holding member and by using the slide rail formed by mutually movably assembling a plurality of rails as an paper feeding member, the precision of the mechanism can be maintained for a long time, the load can be reduced when the paper feeding apparatus is operating, and smooth move can be obtained when the paper feeding apparatus is moving forward and backward. Therefore, a paper feeding apparatus having excellent operability can be provided.

As above, in the embodiment of the present invention, the engaging-holding member that engages with and holds the paper feeding apparatus to enable moving forward and backward for the exterior housing 310 of the image forming apparatus, is fitted on a specific one of the exterior wall faces of the paper feeding apparatus corresponding to the specification as to the accessing scheme of the image forming apparatus. Thereby, only fitting the engaging-holding member corresponding to the accessing scheme enables use of a common paper feeding apparatus regardless of the accessing scheme.

By integrally configuring the paper feeding cassette 81 and the paper sheet transporting path 325 into the frame body 301, simplification of the components thereof is enabled and reduction of the manufacture cost can be facilitated. The number of parts can also be reduced and, therefore, screw-fitting positions of the paper feeding apparatus can be reduced and easier setting of the reference position of the paper feeding apparatus is enabled. Thereby, the precision of the disposing position of the paper feeding apparatus against the image forming apparatus can be improved. Thereby, troubles such as mis-picking up and double feeding in the paper feeding process for the paper sheets can be solved and jamming of the paper sheet being transported is solved. Therefore, improvement of the efficiency of the printing processing can be facilitated.

In the above embodiment, the exterior wall on which the slide rail 303 is fitted to the frame body 301 is the right side exterior wall or the front exterior wall of the frame body 301. However, the wall is not limited to the above and, for the front accessing scheme employed for an MFP, etc., the slide rail 303 may be provided for the left side exterior wall of the frame body 301 and, for the side accessing scheme employed for a printer, etc., the slide rail 303 may be provided for the back exterior wall of the frame body 301. In this case, the fitting position of the roller 304 is on the closer right side of the frame body 301.

Another embodiment may have a configuration according to which the slide rail 303 is provided for each of the two opposite exterior walls of the frame body 301. That is, for the front accessing scheme employed for an MFP, etc., the slide rail 303 may be provided for each of the exterior walls on both of the right and the left sides of the frame body 301 and, for the side accessing scheme employed for a printer, etc., the slide rail 303 may be provided for each of the exterior walls on both of the front and back sides. In this case, the roller 304 is not necessary and the frame body 301 can be stably retained by the two slide rails 303.

In the above embodiment, the roller 304 that freely rotates forward, backward, rightward and leftward is used as a supporting member. However, using a roller that can freely rotates around a rotation shaft, the roller may properly be fitted such that the rotation direction of the roller can match according to the accessing scheme of the paper feeding apparatus.

In addition, a sliding member that slides on the apparatus exterior housing 310 of the image forming apparatus may be used as the supporting member. For example, a resin material having a low friction coefficient such as, for example, silicone may be provided as a protrusion for the bottom face of the frame body 301 and the tip of the material may be brought into contact with the bottom wall of the apparatus exterior housing 310 and, when the frame body 301 is moved forward or backward, the resin material may slid against the apparatus exterior housing 310.

According to the present invention, the following effects can be obtained.

According to the present invention, for a paper feeding apparatus of an image forming apparatus having an accessing scheme different from that of the paper feeding apparatus, a paper feeding apparatus of the image forming apparatus can be provided, that has a configuration commonly usable regardless of the accessing scheme, that can facilitate reduction of the cost by reducing the term of the development thereof, and that can improve the operability of thereof.

According to the present invention, an engaging-holding member that engages with and holds the paper feeding apparatus to enable moving forward and backward for the exterior housing of the image forming apparatus, is fitted on a specific wall face of the exterior wall faces of the paper feeding apparatus corresponding to the specification as to the accessing scheme of the image forming apparatus. Thereby, only fitting the engaging-holding member corresponding to the accessing scheme enables use of a common paper feeding apparatus regardless of the accessing scheme.

According to the present invention, a paper sheet accumulating portion that accumulates paper sheets and a paper sheet transporting path that transports one by one the paper sheets accumulated in the paper sheet accumulating portion to an image forming portion of the image forming apparatus, are integrally configured into the paper feeding apparatus and, thereby, simplification of the components thereof is enabled and reduction of the manufacture cost can be facilitated.

According to the present invention, because the number of parts can be reduced, the screw-fitting portions of the paper feeding apparatus can be reduced and the setting of the reference position of the paper feeding apparatus is facilitated. Thereby, the precision of the disposing position of the paper feeding apparatus against the image forming apparatus can be improved. Thereby, troubles such as mis-picking up and double feeding in the paper feeding process for the paper sheets can be solved and jamming of the paper sheet being transported is solved. Therefore, improvement of the efficiency of the printing processing can be facilitated.

According to the invention, paper feeding mechanisms respectively for a multifunction apparatus (for example, an MFP) and a single-function apparatus (for example, a printer) in an image forming apparatus can be commonly developed and, therefore, not only that the term for the development can be reduced but also the number of parts ordered can be increased when the parts are ordered and reduction of the cost is enabled.

According to the invention, in the case where an engaging-holding member is disposed on a specific exterior wall of the paper feeding apparatus, when the paper feeding apparatus is used for a multifunction apparatus, the engaging-holding member is provided for the side exterior wall face of the paper feeding apparatus that moves forward and backward, and the side exterior wall face of the paper feeding apparatus is engaged and held with the exterior housing of the multifunction apparatus, and when the paper feeding apparatus is used for a single-function apparatus, the engaging-holding member is provided for the front exterior wall face of the paper feeding apparatus that moves rightward and leftward, and the front exterior wall face of the paper feeding apparatus is engaged and held with the exterior housing of the single-function apparatus and, thereby, one paper feeding apparatus can be applied to two image forming apparatuses respectively having two different accessing schemes and improvement of the convenience of the paper feeding apparatus can be facilitated.

According to the invention, by using a slide rail formed by mutually movably assembling a plurality of rails as an paper feeding member, the precision of the mechanism can be maintained for a long time, the load can be reduced when the paper feeding apparatus is operating, and smooth move can be obtained when the paper feeding apparatus is moving forward and backward. Therefore, a paper feeding apparatus having excellent operability can be provided.

According to the present invention, by providing a supporting member for the bottom wall of the paper feeding apparatus to support the paper feeding apparatus, the paper feeding apparatus that is supported by the engaging-holding member can be stabilized by supporting the apparatus using the supporting member and, therefore, the reliability of the paper feeding operation and the moving forward and backward of the paper feeding apparatus can be improved.

The invention claimed is:

1. A paper feeding apparatus in combination with an exterior housing of an image forming apparatus and configured for use in a state where the paper feeding apparatus accumulates paper sheets for the image forming apparatus to form images thereon when the paper feeding apparatus is attached to a main body of the image forming apparatus, the paper feeding apparatus comprising:

an engaging-holding member is provided on an exterior wall face of the paper feeding apparatus, and the engaging-holding member engages and holds the paper feeding apparatus with the exterior housing of the image forming apparatus so as to enable the paper feeding apparatus to move into/from the exterior housing of the image forming apparatus, the exterior wall face being parallel to a moving direction of the paper feeding apparatus, the paper feeding apparatus comprises a supporting member on a bottom wall of the paper feeding apparatus to support the paper feeding apparatus, the supporting member is disposed around an inside of an intersection of a plurality of exterior wall faces of the paper feeding apparatus, and is configured to move inside the main body of the image forming apparatus while supporting the paper feeding apparatus when the paper feeding apparatus moves in the moving direction, the plurality of exterior wall faces includes an exterior wall positioned respectively on an opposite side of the exterior wall face to which the engaging-holding member of the image forming apparatus is fitted, and to a bottom wall of the exterior housing, a groove portion is provided for two directions which are orthogonal to each other, and the groove portion receives the supporting member to guide the movement of the supporting member.

2. The paper feeding apparatus as defined in claim 1, wherein the paper feeding apparatus integrally comprises:

a paper sheet accumulating portion that accumulates the paper sheets; and a paper sheet transporting path that constitutes a portion of a transporting path that transports one by one the paper sheets accumulated in the paper sheet accumulating portion.

3. The paper feeding apparatus as defined in claim 1, wherein the image forming apparatus is one of an MFP (Multifunction Peripheral) that is a multifunction apparatus, or a printer that is a single-function apparatus, the MFP and printer providing for different moving directions of the paper feeding apparatus, and wherein the paper feeding apparatus is provided with the engaging-holding member corresponding to the moving direction of the paper feeding apparatus within either the MFP or the printer.

4. The paper feeding apparatus as defined in claim 3, wherein the image forming apparatus is the MFP and the moving direction of the paper feeding apparatus within the MFP is a direction forward and backward.

5. The paper feeding apparatus as defined in claim 4, wherein the exterior wall face the engaging-holding member is provided on is a side exterior wall face of the paper feeding apparatus that moves forward and backward and engages and holds the side exterior wall face of the paper feeding apparatus with the exterior housing of the MFP.

6. The paper feeding apparatus as defined in claim 3, wherein the image forming apparatus is the printer and the moving direction of the paper feeding apparatus within the printer is a direction rightward and leftward.

7. The paper feeding apparatus as defined in claim 6, wherein the exterior wall face the engaging-holding member is provided on is a front exterior wall face of the paper feeding apparatus that moves rightward and leftward and engages and holds the front exterior wall face of the paper feeding apparatus with the exterior housing of the printer.

8. The paper feeding apparatus as defined in claim 1, wherein the engaging-holding member is a slide rail formed by mutually movably assembling a plurality of rails.

9. The paper feeding apparatus as defined in claim 1, wherein the supporting member is a roller that can freely rotate forward, backward, rightward and leftward.

10. The paper feeding apparatus as defined in claim 1, wherein the supporting member is a sliding member that slides on the main body of the image forming apparatus.

* * * * *